United States Patent [19]

Chauvier

[11] 4,023,227

[45] May 17, 1977

[54] APPARATUS FOR CLEANING SUBMERGED SURFACES

[76] Inventor: Fernand Louis Oscar Joseph Chauvier, 7 Caribou Road, Selcourt, Springs, Transvaal Province, South Africa

[22] Filed: Feb. 23, 1976

[21] Appl. No.: 660,663

[30] Foreign Application Priority Data

Feb. 25, 1975 South Africa ..... 75/1166
Mar. 24, 1975 South Africa ..... 75/1848

[52] U.S. Cl. ..... 15/1.7; 15/404
[51] Int. Cl.[2] ..... E04H 3/20
[58] Field of Search ..... 15/1.7, 404, 416, 419

[56] References Cited

UNITED STATES PATENTS 2,257,574 9/1941 Ray ..... 15/404
2,321,648 6/1943 Brunner, Jr. ..... 15/404

*Primary Examiner*—Edward L. Roberts
*Attorney, Agent, or Firm*—Wood, Herron & Evans

[57] ABSTRACT

The invention disclosed herein relates to an apparatus for automatically cleaning surfaces submerged within a liquid, such as the walls and floors of swimming pools. The apparatus comprises two suction passages in suction communication with a cleaning head that is releasably engageable with the surface to be cleaned and means, such as a flapper valve, for automatically transferring the flow of liquid from one passage to the other. By this means, as the flow of liquid in a passage is halted, the kinetic energy of the liquid is transferred to the apparatus, causing it to be displaced along the surface. The apparatus thus migrates randomly across the surface, cleaning it.

22 Claims, 5 Drawing Figures

APPARATUS FOR CLEANING SUBMERGED SURFACES

BACKGROUND OF THE INVENTION

This invention relates to an apparatus for cleaning a surface submerged within a liquid. In particular, the invention relates to an apparatus for automatically cleaning swimming pools.

According to the invention there is provided a cleaning apparatus for automatically cleaning a surface submerged in a liquid, the apparatus including a cleaning head having a peripheral region releasably engageable with the surface to be cleaned; two suction passages in suction communication with the head through communication openings therein; and means for automatically transferring liquid flow through the passages from the head alternately and repeatedly from one of the passages to the other.

The suction passages may be linear and may be defined by a rigid material. The passages may have a suitable constant cross-sectional area and may be of a suitable length, dependent on the suction pressure applied to the passages, such that the liquid flowing through either of the passages has sufficient kinetic energy so that when the flow of liquid is transferred to the other passage, sufficient energy is transferred to the apparatus to displace it along the surface to be cleaned. Thus, the means for transferring the liquid flow may be adapted to suddenly halt the flow of liquid through one passage when transferring the liquid flow. By this means, an impulsive force is applied to the apparatus due to the kinetic energy of the liquid flowing in the passage. Further, due to the inertia of the liquid in the passage to which flow is transferred, the suction pressure in the head is decreased when the flow of the liquid is transferred, thereby decreasing the frictional engagement between the head and the surface and allowing the apparatus to be displaced. When the liquid flow increases to its maximum value, the suction pressure increases resulting in the head gripping the surface.

Conveniently, the passages may have the same length. The cleaning head may have a mouth, the region of the head defining the mouth being the peripheral region of the head referred to earlier. This peripheral region may be planar so that the apparatus is particularly suitable for cleaning planar surfaces. With such a planar peripheral region, the axes of the suction passages may be located parallel to each other at an acute angle, preferably of 45°, to the plane of the peripheral region. The passages may be oriented in any suitable fashion with respect to the plane of the peripheral region. For example, the axes of the suction passages may be located in a plane perpendicular to the plane of the peripheral region; or alternatively, the passages may be located adjacent each other in a plane which intersects the plane of the peripheral region of the cleaning head at the same angle as the angle between the axes of the passges and the plane of the peripheral region.

The means for automatically transferring the liquid flow from one passage to the other may comprise a flapper valve that is pivotally mounted about a pivotal axis to be sealingly displaceable against valve seats located at the communication openings. This valve may be adapted so that liquid flow from the head into one of the passages tends to displace the valve into sealing engagement with the valve seat of that passage, simultaneously opening the communication opening between the other passage and the head. The pivotal axis may be located either parallel to or at an acute angle to the plane of the peripheral region. In other words, if the head is seated on a horizontal surface the valve will be pivotable in either a vertical or a horizontal plane. In order to assist in displacing the apparatus, one or both of the valve seats may be disposed so that when it is struck by the valve, the apparatus experiences a net force that has a component parallel to the plane of the peripheral region, which reinforces the force exerted on the apparatus due to the kinetic energy of the fluid flowing in its respective passage.

In order to cater for irregularities in the surface to be cleaned, to cater for curved transition zones between adjacent planar surface sections, and to assist in the cleaning action, the apparatus may have a sealing flange of a flexible material about the mouth of the cleaning head. This flange may be rotatably secured to the head. As the suction grip of the head on the surface is increased by such a flange, a relief opening may be provided in the head. Further, the surface of the flange which engages the surface to be cleaned may have an abrasive lining or a brush to assist in cleaning the said surface.

The suction passages may be defined by two tubes, or by a tube having an internal partition. The free ends of the passages will be connectable to a flexible hose by means of which a suction pressure may be applied to the apparatus. These free ends of the passages that are remote from the head may have a common suction inlet having a swivelling coupling that is connectable to the flexible hose.

A regulator valve may also be provided for regulating the suction pressure.

The center of gravity of the apparatus may be located close to the cleaning head. The apparatus may have a buoyancy member to decrease the effective weight of the apparatus in the liquid. The buoyancy member may be disposed on the opposite side to the peripheral region of the head, so that when the apparatus falls through the liquid onto the surface it is correctly oriented for the peripheral region to seat on the surface.

The apparatus may further have means to turn itself when it climbs a vertical wall, the surface of which is being cleaned, to prevent the head breaking the surface of the liquid. Accordingly, the apparatus may include a displaceable ballast member which is automatically displaced due to the action of gravity away from the cleaning head when the peripheral region of the cleaning head is vertically oriented and the apparatus is tilted over a predetermined degree, and which automatically returns to its original position closer to the cleaning head when the peripheral region is horizontally oriented. The ballast member may be a massy ball that is housed in a V-shaped housing disposed with its apex towards the cleaning head.

The cleaning apparatus may be partly or entirely of a mouldable synthetic plastics material. For example, the cleaning head and the valve may be moulded from polyurethane or the like.

The apparatus may be particularly adapted to clean the walls and the floors of the swimming pools. The suction pressure may then be exerted by a conventional pump utilized with the swimming pool, the water sucked through the apparatus being cleaned by the associated filter of the swimming pool.

The invention will now be described, by way of examples, with reference to the accompanying drawings, in which.

Figure 1:
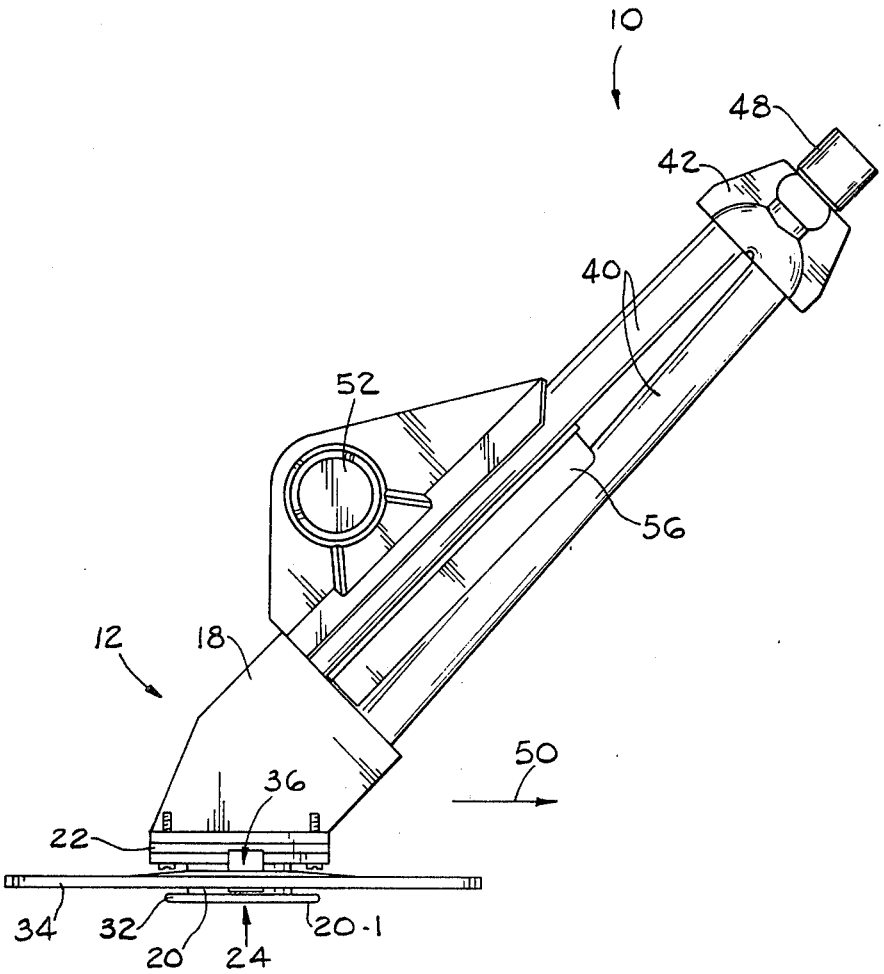
FIG. 1 shows a side view of a cleaning apparatus in accordance with the invention.
Figure 2:
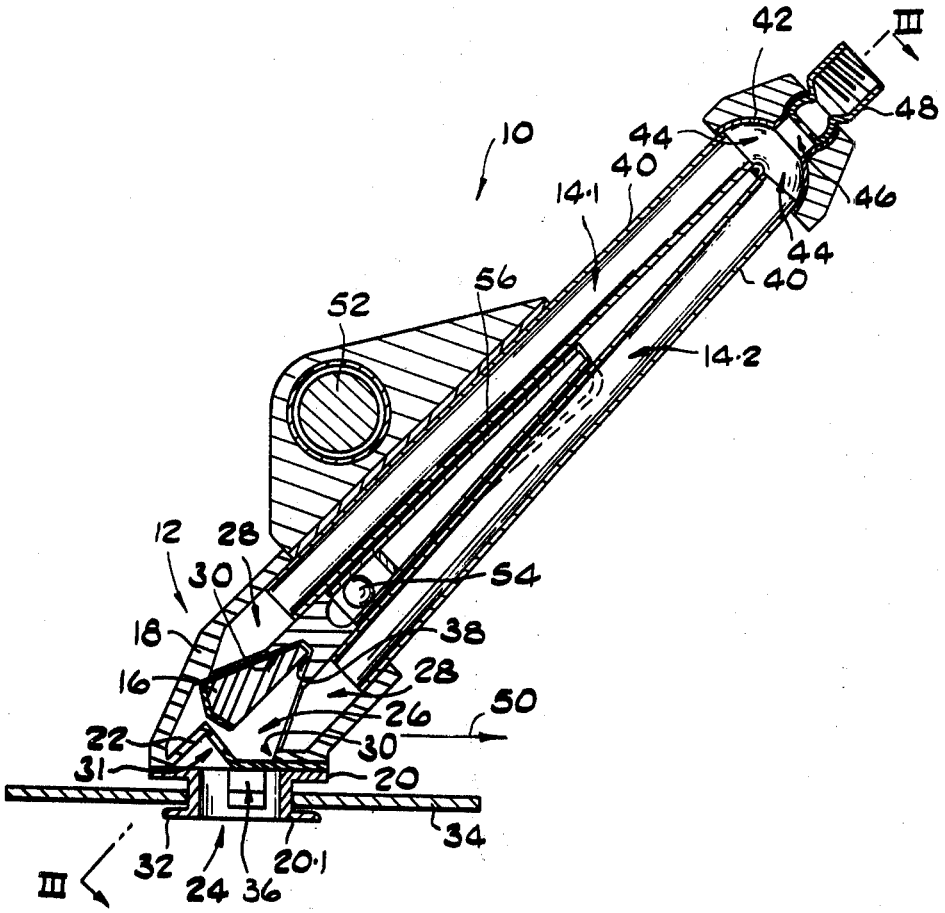
FIG. 2 shows a sectional longitudinal view of the cleaning apparatus.
Figure 3:
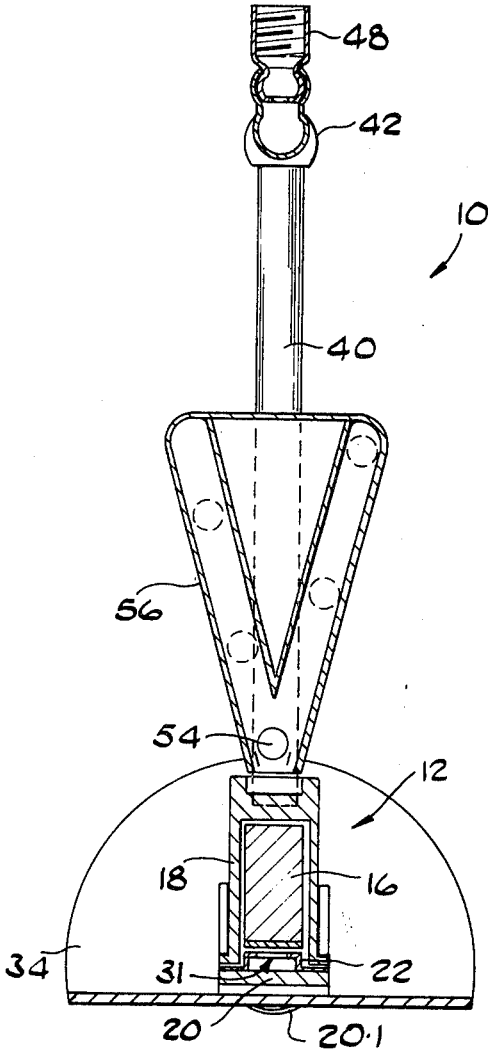
FIG. 3 shows a further longitudinal sectional view of the apparatus along line III—III in FIG. 2.

Referring initially to FIGS. 1, 2 and 3, a cleaning apparatus for automatically cleaning the walls and the floor of a swimming pool (not shown) is referred to generally by reference numeral 10. The apparatus 10 basically comprises a hollow cleaning head 12 that is in suction communication with two suction passages 14.1 and 14.2 and a flapper valve 16 that is pivotally displaceable to repeatedly automatically transfer, in operation, flow of water from the head 12 to one passage 14.1, 14.2 or the other.

The head 12 is formed from three parts, a body member 18, a base member 20 and an intermediate flow directing member 22. The base member 20 is hollow and has a planar peripheral region 20.1 which defines the mouth 24 of the head 12. This peripheral region 20.1 seats in use against the floor or wall of the swimming pool, due to the suction pressure in the head 12, as will be explained hereinafter. The body member 18 is also hollow to define a head chamber 26 which opens into two bores 28. At the entrances to these bores 28, from the head chamber 26, are provided valve seats 30 against which the valve 16 seats to close off the bores 28 from the head chamber 26. The head chamber 26 is in communication with the mouth 24, defined by the base member 20, via a flow directing opening 31 provided in the intermediate member 22. This opening 31 is located such that water that flows from the mouth 24 through the chamber 26 into one of the bores 28 (the other being closed by the valve 16) causes the valve 16 to be operated to close the bore 28 that is open at that time, thereby to switch the flow of water from one bore 28 to the other. The base member 20 has a lip 32 adjacent the peripheral region 20.1, to locate and retain a flexible sealing flange 34. Conveniently, the base member 20 is circular so that the sealing flange 34 is rotatable about it, being retained by the lip 32. In order to relieve the suction force with which the head 12 would grip the floor or wall of the swimming pool, relief openings 36 are provided in the side wall of the base member 20.

As can be seen in FIG. 2, the valve 16 is triangular in cross-section, the apex being received in a recess 38 in the body member 18, that is located between the valve seats 30. This recess 38 locates the valve 16 such that it is pivotally displaceable from and against one valve seat 30 to the other.

The suction passages 14.1 and 14.2 are defined by rigid linear pipes 40 that at one end are sealingly secured in the bores 28 in the body member 18. The bores 28 are such that the pipes 40 are parallel to each other and at an angle of 45° to the plane defined by the peripheral region 20.1. Further, the pipes 40 are adjacent each other in a plane that is perpendicular to the plane of the peripheral region 20.1. Thus, if the peripheral region 20.1 was to be seated against a horizontal floor section of the swimming pool, the pipes 40 would be above and below each other. Similarly, the valve 16 is pivotable about an axis that is parallel to the plane of the peripheral region 20.1, to be movable in a vertical direction.

As will be clearly seen in FIG. 2, the valve seats 30 are such that when first and then the other is struck by the valve 16, the body member 18 experiences a driving force that has a net component in a direction parallel to the plane of the peripheral region 20.1 towards the side to which the pipes 40 are angled, as shown by the arrow 50.

Figure 5:
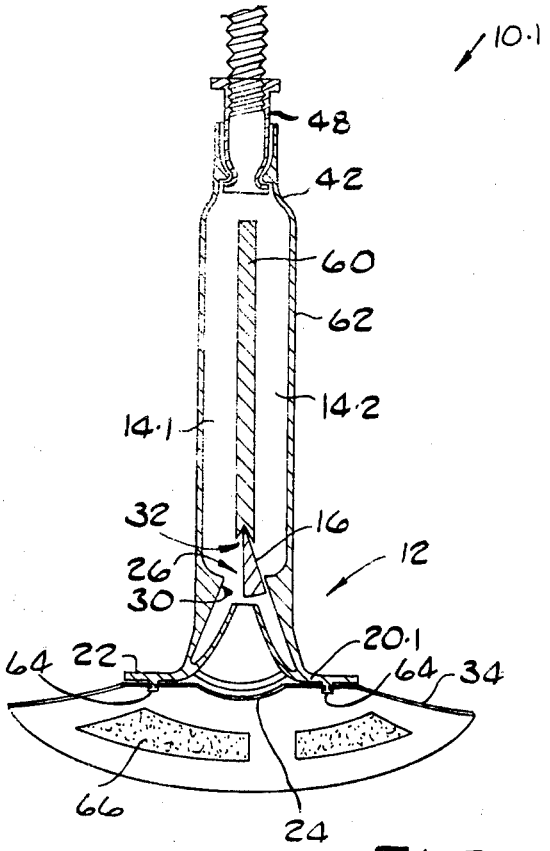
FIG. 5 shows a longitudinal sectional view, of this further embodiment, along line IV—IV in FIG. 4.

The other ends of the pipes 40 are secured to a junction member 42. The junction member 42 has two bores 44 at one end, in which the pipes 40 are received, which join together in a single bore 46 at the other end of the junction member 42. At this end, the junction member 42 has a swivel coupling 48 that is internally screw-threaded and which is attachable to a spiral wound flexible hose (as shown in FIG. 5).

The apparatus 10 is connected to the pump of the swimming pool by means of this hose. In some cases, depending on the suction pressure which may be developed by the pump, a by-pass valve (not shown) may be provided to regulate the suction pressure applied to the apparatus 10.

The apparatus 10 further has a buoyancy member 52 secured to the dorsal pipe 40 so that when the apparatus 10 falls to the floor of the swimming pool it assumes the correct attitude for the mouth 24 to seat against the floor. A displaceable ballast member, in the form of a lead ball 54, is also provided. The ball 54 is constrained to be movable in the arms of a V-shaped housing 56 that is mounted between the pipes 40 with the apex of the V towards the head 12.

The operation of the apparatus 10 is as follows:

Assuming that the mouth 24 is seated against the floor of the swimming pool, and a suction pressure is applied at the entrace bore 46 of the junction member 42 via the swivel coupling 48. Water is sucked through the mouth 24 and the relief openings 36 in the base member 20 of the head 12, through the opening 31 in the intermediate member 22, through the head chamber 26 past the valve 16, and through one of the passages 14.1 and 14.2. As the flow of the water will not be such as to keep the valve 16 between the valve seats 30, with both passages 14.1 and 14.2 open, the valve 16 will seat against one of the seats 30, most probably that of the passage 14.2. The suction pressure in the head 12 will hold the apparatus against the floor, and due to the high speed of flow of the water between the flange 34 and the floor, dirt and other particles will be dislodged and drawn through the apparatus 10 to the pump and the associated filter of the swimming pool. The cleaned water is then returned to the pool in the normal way.

The flow of water through the head chamber 26, past the valve 16, and into the passage 14.1 acts on the valve 16 and causes it to be displaced away from the valve seat 30 for the passage 14.2 against the valve seat 30 for the passage 14.1. The flow of water in this passage 14.1 is suddenly stopped. However, the water flowing in the passage 14.1 had kinetic energy, which is transferred to the body member 18, and thus the apparatus 10, via the valve 16. This kinetic energy will be transferred as a force directed along the axis of the passage, and will thus have a vertical component and a horizontal component in the direction of the arrow 50. Further, as the flow rate of the water into the head chamber 26 is decreased, due to the inertia of the water in the passage 14.2, the suction grip of the head 12 on the floor decreases. As a result, the apparatus 10 is slightly displaced in the direction of the arrow 50. As the flow rate of the water increases, the apparatus 10 will tend to experience a downward force in the opposite direction to the previous force. As this force will tend to increase the frictional grip between the head 12 and the floor and as the suctional grip is increased, the apparatus will not be displaced in the reverse direction to the arrow 50. The flow of water through the head chamber 26 causes the valve 16 to be displaced to open the passage 14.1 and close the passage 14.2. This again causes the apparatus 10 to be displaced in the direction of the arrow 50. It will be noted that during this phase of the operation, as the valve seat 30 for the passage 14.2, is disposed substantially vertically, when it is struck by the valve 16, a force is exerted on the head 12 whose major component is in the direction of the arrow 50. This causes the apparatus 10 to be displaced further than when the passage 14.1 is closed, as in the latter case the action of the valve 16 opposes displacement of the apparatus 10.

By this means, the apparatus 10 migrates across the floor of the swimming pool. When the apparatus 10 reaches a wall of the pool, it starts climbing it. Due to the weight of the hose, the apparatus 10 will be tilted over slightly. If the displaceable ball 54 were not provided, the apparatus 10 would then tend to run along the wall. However, when the apparatus tilts over a predetermined amount (determined by the angle between the arms of the housing 56), the ball 54 rolls away from its normal position at the apex adjacent the head. This shifts the centre of gravity of the apparatus 10 and results in the apparatus 10 migrating down the wall. When the apparatus 10 reaches the floor, the ball 54 rolls back to its normal position.

By this means the apparatus 10 migrates randomly about the floor and walls of the swimming pool, cleaning them. It will further be understood that the slight vertical movement of the apparatus 10 causes the flange 34 to flap. This assists in dislodging dirt, algae, leaves, or the like, which are also taken up in the water flow entering the head 12 through the relief openings 36.

Figure 4:
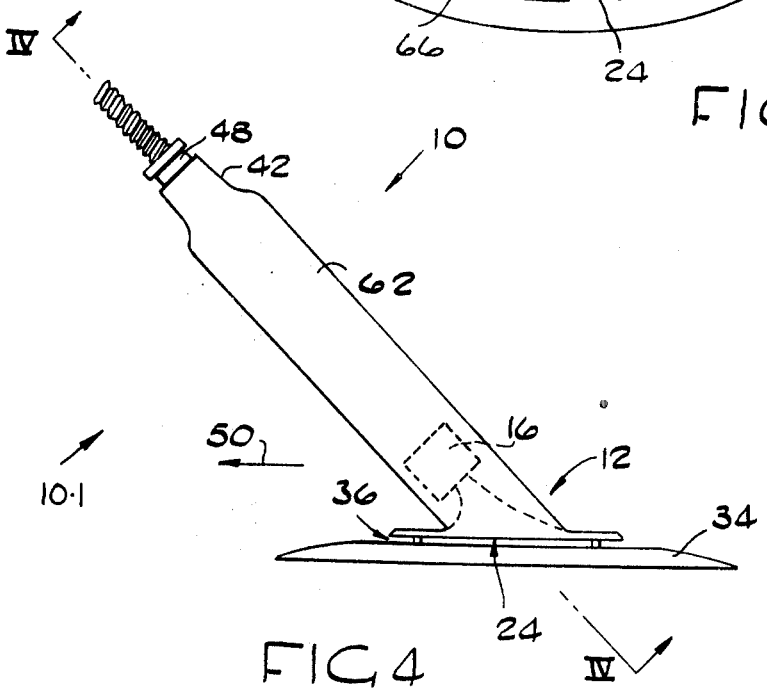
FIG. 4 shows a side view of a further embodiment of a cleaning apparatus in accordance with the invention.

Referring to FIGS. 4 and 5, an alternative embodiment of the apparatus 10.1 is shown. This embodiment is similar to that described earlier, and is correspondingly referenced. With this embodiment the passages 14.1 and 14.2 are defined by a rigid partition 60 in a rigid pipe 62. These passages 14.1 and 14.2 are side-by-side, rather than above and below each other as with the earlier embodiment. In other words, the passages 14.1 and 14.2 lie in a plane that intersects the plane defined by the peripheral region 20.1 at the same angle as that at which the passages intersect the latter plane. Further, the valve 16 is pivotal about an axis that is at an acute angle to the plane defined by the peripheral region 20.1, such that the valve 16 moves more from side-to-side than up-and-down as with the earlier embodiment. The operation of this embodiment is substantially the same as the earlier embodiment, except the striking of the valve seats 30 by the valve 16 causes the apparatus 10 to tend to move in a zig-zag fashion.

This embodiment is also different from that described earlier, in that the flange 34 is attached to the head 12 by studs 64 and the underneath surface of the flange 34 has pieces of sandpaper 66 adhered to it.

It will be understood that the kinetic energy that the water in the passage has will be determined by the rate of flow of the water and its volume (i.e. its mass). The rate of flow will be determined by the suction pressure applied to the apparatus, the lengths of the passages, and the resistance to flow afforded by the head 12 and the passages themselves. Correspondingly, the volume of the water will be determined by the length and the cross-sectional area of the passages. These factors, as well as others such as the minimum depth of the swimming pool, will be considered by those skilled in the art, in the design of apparatus in accordance with the invention for particular applications.

I claim:

1. A cleaning apparatus for automatically cleaning asurface submerged in a liquid, the apparatus including a cleaning head having a peripheral region releasably engageable with the surface to be cleaned; two suction passages in suction communication with the head through communication openings therein; valve seats located at each of the communication openings; and a valve member that is automatically displaceable between and against the valve seats for automatically transferring liquid flow through the passages from the head alternately and repeatedly from one of the passages to the other.

2. A cleaning apparatus as claimed in claim 1, in which the suction passages are defined by a rigid material.

3. A cleaning apparatus as claimed in claim 1, in which the suction passages are linear.

4. A cleaning apparatus as claimed in claim 3, in which the peripheral region of the cleaning head defines a plane and the axes of the suction passages are located parallel to each other at an actue angle to the plane.

5. A cleaning apparatus as claimed in claim 4, in which the axes of the suction passages are at an angle of 45° to the plane.

6. A cleaning apparatus as claimed in claim 4, in which the axes of the suction passages are located in a plane perpendicular to the plane of the peripheral region of the cleaning head.

7. A cleaning apparatus as claimed in claim 4, in which the suction passages are located adjacent each other in a plane which intersects the plane of the peripheral region of the cleaning head at the same angle as the angle between the axes of the passages and the plane of the peripheral region.

8. A cleaning apparatus as claimed in claim 1, in which said valve member is a flapper valve pivotally mounted about a pivotal axis to be sealingly displaceable against the valve seats located at the communication openings.

9. A cleaning apparatus as claimed in claim 8, in which the peripheral region of the cleaning head defines a plane and the pivotal axis is located at an acute angle to this plane.

10. A cleaning apparatus as claimed in claim 8, in which the peripheral region of the cleaning head defines a plane and the pivotal axis is located parallel to this plane.

11. A cleaning apparatus as claimed in claim 8, in which the peripheral region of the cleaning head defines a plane and the valve seats are disposed such that when they are struck by the valve the apparatus experiences a net force that has a component that is parallel to this plane.

12. A cleaning apparatus for automatically cleaning a surface submerged in a liquid, the apparatus including a cleaning head having a peripheral region releasably engageable with the surface to be cleaned and having a sealing flange of a flexible material which is rotatable about the cleaning head; two suction passages in suction communication with the head through communication openings therein; and means for automatically transferring liquid flow through the passages from the head alternately and repeatedly from one of the passages to the other.

13. A cleaning apparatus as claimed in claim 12, which has a relief opening between the sealing flange and the cleaning head.

14. A cleaning apparatus as claimed in claim 1, in which that region of the apparatus that engages the surface to be cleaned has an abrasive lining or a brush to assist in cleaning this surface.

15. A cleaning apparatus as claimed in claim 1, in which the suction passages are defined by two tubes.

16. A cleaning apparatus as claimed in claim 1, in which the ends of the passages remote from the head have a common suction inlet having a swivelling coupling that is attachable to a flexible hose.

17. A cleaning apparatus as claimed in claim 1, in which the centre of gravity of the apparatus is located close to the cleaning head.

18. A cleaning apparatus for automatically cleaning a surface submerged in a liquid, the apparatus including a cleaning head having a peripheral region releasably engageable with the surface to be cleaned; two suction passages in suction communication with the head through the communication openings therein; means for automatically transferring liquid flow through the passages from the head alternately and repeatedly from one of the passages to the other; and a displaceable ballast member which is automatically displaced due to the action of gravity away from the cleaning head when the peripheral region of the cleaning head is vertically oriented and the apparatus is tilted over a predetermined degree, and which automatically returns to its original position closer to the cleaning head when the peripheral region is horizontally oriented.

19. A cleaning apparatus as claimed in claim 18, which includes a V-shaped ballast housing in which the ballast member is housed, the ballast housing being oriented with its apex towards the cleaning head.

20. A cleaning apparatus as claimed in claim 18 which includes a buoyancy member.

21. A cleaning apparatus as claimed in claim 1, which is of a mouldable synthetic plastics material.

22. A cleaning apparatus as claimed in claim 1, in which the suction passages are defined by a tube having an internal dividing partition.

* * * * *